US010982420B2

(12) United States Patent
Wu et al.

(10) Patent No.: US 10,982,420 B2
(45) Date of Patent: Apr. 20, 2021

(54) DRAIN PLUG LINKAGE ARRANGEMENT

(71) Applicant: Purity (Xiamen) Sanitary Ware Co., Ltd., Xiamen (CN)

(72) Inventors: James Wu, Taichung (TW); Alex Wu, Taichung (TW); Ce-Wen Yang, Xiamen (CN); Peng-Wei Xie, Xiamen (CN)

(73) Assignee: PURITY (XIAMEN) SANITARY WARE CO., LTD., Xiamen (CN)

( * ) Notice: Subject to any disclaimer, the term of this patent is extended or adjusted under 35 U.S.C. 154(b) by 0 days.

(21) Appl. No.: 16/730,211

(22) Filed: Dec. 30, 2019

(65) Prior Publication Data

US 2020/0385970 A1 Dec. 10, 2020

(30) Foreign Application Priority Data

Jun. 6, 2019 (CN) ..... 201920849192.1

(51) Int. Cl.
*E03C 1/23* (2006.01)

(52) U.S. Cl.
CPC ..... *E03C 1/2306* (2013.01)

(58) Field of Classification Search
CPC ..... E03C 1/2306; E03C 1/2302; A47K 1/14
USPC ..... 4/689
See application file for complete search history.

(56) References Cited

U.S. PATENT DOCUMENTS

2010/0050337 A1* 3/2010 Li ..... E03C 1/23 4/689
2014/0310864 A1* 10/2014 Ye ..... E03C 1/2302 4/295
2015/0299995 A1* 10/2015 Ye ..... E03C 1/2302 4/295
2017/0183851 A1* 6/2017 Lin ..... E03C 1/2302
2018/0171610 A1* 6/2018 Ahuja ..... E03C 1/2302
2019/0345703 A1* 11/2019 Peng ..... A47K 1/14
2020/0011037 A1* 1/2020 Lin ..... E03C 1/2302

FOREIGN PATENT DOCUMENTS

CN 103967082 B 7/2015
CN 103835348 B 4/2016

* cited by examiner

*Primary Examiner* — Benjamin R Shaw
(74) *Attorney, Agent, or Firm* — Birch, Stewart, Kolasch & Birch LLP

(57) ABSTRACT

The present invention discloses a drain plug linkage arrangement including a pull rod assembly, an operating rod, a drain plug, and a drain pipe, wherein the drain plug is movably mounted in the drain pipe. The pull rod assembly includes a pull rod and a connecting rod, wherein the pull rod is connected to the connecting rod via a button. A first end of the operating rod is inserted into the drain pipe from a sidewall of the drain pipe and is connected to the drain plug. The operating rod is connected to the connecting rod of the pull rod assembly. Assembly and disassembly between the pull rod and the connecting rod disclosed in the present invention are very convenient.

15 Claims, 17 Drawing Sheets

DRAIN PLUG LINKAGE ARRANGEMENT

BACKGROUND OF THE INVENTION

Technical Field

The present invention relates generally to a sink drain, and more particularly to a drain plug linkage arrangement.

Description of Related Art

A sink drain, also known as drainage device, is usually provided in vessels, such as a sink, a bathtub, and a hand basin, in order to store or to drain water in the vessels, wherein such drainage device could be a drain plug linkage arrangement. For example, a conventional drainage device includes a drain pipe which communicates with a drain hole of a vessel, wherein a drain plug is mounted to the drain hole. The drain plug is connected to an end of an operating rod (such as a lever member), and another end of the operating rod is connected to a pulling member extending downwardly, so that the drain plug can be moved between a close position and an open position to close or open the drain hole by manipulating the pulling member, thereby to store or to drain water in the vessel. A spherical body is disposed on the operating rod as a pivot of the operating rod. Generally, the spherical body is rotatably mounted in a sleeve, and the sleeve is threaded into an opening on a side wall of the drain pipe. However, a user needs to screw the sleeve many turns to engage the sleeve and the opening, and that is inconvenient for assembling and disassembling.

Generally, the pulling member includes a pulling rod and a connecting rod. The connecting rod is adapted to be connected to the operating rod, and the pulling rod is adapted to be manipulated by the user, wherein the pulling rod and the connecting rod are usually connected in two ways. In the first way, the pulling rod has a hook portion in a bottom end, and the connecting rod has a connecting hole, so that the hook portion of the pulling rod hooks to the connecting hole to connect the pulling rod and the connecting rod. However, such connection is unstable, for the hook portion of the pulling rod is easily disengaged from the connecting hole while the pulling rod is moved downward. The second way is fastening the pulling rod and the connecting rod with a screw, which is inconvenient during assembling process. Therefore, a drain plug linkage arrangement is disclosed in a China patent (CN103835348B), a pulling rod assembly of the drain plug linkage arrangement includes a pulling rod, a connecting rod, and a connector, wherein the connecting rod has a receiving portion on a top thereof, and the connector has a central hole and is adapted to be stuck to the receiving portion. The restricting portion is formed at a bottom portion of the pulling rod and is adapted to be got stuck into the central hole. The receiving portion has a deformable portion which is adapted to expand the central hole, thereby while the connector is received by the receiving portion, the central hole could be deformed between an unexpanded position and an expanded position. While installing the pulling rod, the pulling rod is inserted into the central hole, so that the restricting portion of the pulling rod is got stuck to the central hole of the connector; after that, the connector is connected to the receiving portion of the connecting rod, and thereby the pulling rod and the connecting rod are connected. While disassembling the pulling rod, the connector is pressed to move down the connector to expand the central hole, so that the restricting portion of the pulling rod is detached from the central hole, thereby the pulling rod can be pulled out. However, since the pulling rod is inserted into the central hole of the connector, the pulling rod may hinder the user from pressing a top center of the connector. Therefore, in order to stably, smoothly and straightly press the connector down, the user needs to press two opposite sides of a top portion of the connector at the same time, which is inconvenience for operation.

Moreover, in order to fit sinks of different size, a connecting site between the operating rod and the connecting rod of some drain plug linkage arrangement is adjustable. For example, in China patent No. CN103967082B, a drain plug linkage arrangement is disclosed, wherein a connecting rod of the drain plug linkage arrangement has a plurality of perforations and is slidably mounted with a joint structure. The operating rod can be passed through one of the perforations and has a plurality of flange and a plurality of grooves. The joint structure can slide along the connecting rod. When the joint structure slides to the connecting site between the connecting rod and the operating rod, the joint structure stops the operating rod moving in a direction of an axis of the corresponding perforation. However, a problem existing in such structure is that the joint structure needs to be mounted above the operating rod to avoid the joint structure from being disengaged from the corresponding groove due to the effects of gravity. Therefore, when assembling the operating rod and the connecting rod, the joint structure needs to be mounted to the connecting rod in advance, and then moving the joint structure above the connecting site between the operating rod and the connecting rod; after that, the operating rod is passed through one of the perforations on the connecting rod; finally, the joint structure is slid down to be got stuck with the corresponding groove of the operating rod, in order to stop the operating rod moving in the axial direction of the corresponding perforation. As a result, the mounting process of the conventional drain plug linkage arrangement is more complicated and inconvenient.

BRIEF SUMMARY OF THE INVENTION

In view of the above, the primary objective of the present invention is to provide a drain plug linkage arrangement including a pull rod and a connecting rod that could be easily assembled and disassembled.

The invention provides a drain plug linkage arrangement, including a pull rod assembly, an operating rod, a drain plug, and a drain pipe, wherein the drain plug is movably disposed in the drain pipe. The pull rod assembly includes a pull rod and a connecting rod which is connected to the pull rod. The operating rod has a first end and a second end, wherein the first end of the operating rod is inserted into the drain pipe from a sidewall of the drain pipe and is connected to the drain plug. The operating rod is connected to the connecting rod. An annular fixing groove is formed on a lower portion of said pull rod. The connecting rod has a cavity in a top portion of the connecting rod, wherein the connecting rod has a through hole on a top of the cavity and a side hole on a side wall of the cavity. The lower portion of the pull rod is inserted into the cavity from the through hole. A button is movably disposed in the cavity, and an outer end of the button forms a pressing surface. An inner portion of the button is inserted into the cavity from the side hole of the connecting rod and is able to be moved between a first position and a second position in an axial direction of the side hole; the inner portion of the button has a positioning notch, and an edge of the positioning notch is movably engaged with an annular fixing groove. The connecting rod further includes a button resilient structure which is constituted by the cavity and the button. When the pressing surface of the button is released from being pressed, the button resilient structure urges the button to move to the first position, so that the edge of the positioning notch is engaged into the annular fixing groove. When the pressing surface of the button is pressed to move to the second position, the edge of the positioning notch is disengaged from the annular fixing groove.

In an embodiment, said button resilient structure is constituted by two elastic arms respectively connected to two sides of the button and two guiding slopes formed on an interior wall of said cavity; each of the two elastic arms abuts against one of the two guiding slopes.

In an embodiment, at least two elastic hooks are disposed on the button, and the interior wall of the cavity has a blocking edge which is adapted to be movably engaged with the at least two elastic hooks.

In an embodiment, a plurality of positioning slots is disposed on a rear surface of the operating rod, and a plurality of slanted guiding surfaces is disposed on a front surface of the operating rod corresponding to the plurality of positioning slots, wherein each of the plurality of slanted guiding surfaces is rearward slanted from top down; a plurality of positioning perforations are arranged in an axial direction of the connecting rod; a sliding clip is movably mounted on the connecting rod and has a tilted surface matching with the plurality of slanted guiding surfaces, and the tilted surface is adapted to be selectively abutted against the plurality of slanted guiding surface; the second end of the operating rod passes through one of the plurality of positioning perforations of the connecting rod; when the tilted surface of the sliding clip abuts against the slanted guiding surface of the operating rod, the operating rod is pressed by the tilted surface of the sliding clip to move rearward, so that the edge of the corresponding positioning perforation passed through by the second end of the operating rod gets stuck into one of the positioning slots.

In an embodiment, a curved protruding portion is formed at an upper end of the tilted surface and is adapted to be detachably engaged with a top surface of the operating rod; a stopping protruding portion is formed at a lower end of the tilted surface and is adapted to be abutted against a bottom surface of the operating rod.

In an embodiment, the operating rod includes a spherical body which is located between the first end and second end of the operating rod and is rotatably disposed in a sleeve; an external wall of the sleeve has two restricting protruding portions on opposite sides of the external wall, and each of the two restricting protruding portions has a restricting groove; a tube with an opening is formed on a side wall of the drain pipe for mounting the operating rod, and two positioning grooves corresponding to the two restricting protruding portions and extending in an axial direction of the opening formed on an inner wall of the tube; a first perforation is formed on two opposite walls of one of the positioning grooves, and a second perforation is formed on two opposite walls of the other positioning groove; an axial direction of the first perforation and an axial direction of the second perforation are parallel to an axial direction of the through hole; at least a part of said sleeve is disposed into the tube via the opening, and the two restricting protruding portions are movably and respectively engaged with the two positioning grooves; an U-shaped ring is mounted onto the tube and includes a pressing portion and two restricting arms respectively and oppositely connected to two opposite ends of the pressing portion; an elastic portion is disposed on an inner side of the pressing portion and is adapted to be abutted against an outer wall of the tube; an inner side of each of the restricting arms is disposed with a blocking member; the two restricting arms respectively pass through the first perforation and the second perforation of the two positioning grooves, and the blocking members are movably engaged with the restricting grooves.

In an embodiment, an end portion of each of the restricting arms is disposed with a blocking hook; two locking portions are disposed on the outer wall of the tube and are adapted to be engaged with the blocking hooks.

In an embodiment, the elastic portion is an elastic claw connected to the inner side of the pressing portion.

In an embodiment, the sleeve is constituted by a connecting seat and a connecting cap, wherein the connecting seat and the connecting cap are joined to each other to form the sleeve; a first through hole is disposed on the connecting seat and is adapted to be passed through by the first end of the operating rod, and a second through hole is disposed on the connecting cap and is adapted to be passed through by the second end of the operating rod; the two restricting protruding portions are disposed on an outer wall of the connecting cap.

With the aforementioned design, when the pull rod is about to be engaged with the connecting rod, the pressing surface of the button is pressed first to move the bottom to the second position; then, the lower portion of the pull rod is inserted into the cavity via the through hole; finally, release the button and the button resilient structure could drive the button move back to the first position, so that the edge of the positioning notch is got stuck in the annular fixing groove, thereby to fix the lower portion of the pull rod in the cavity. When the pull rod is about to be disassembled from the connecting rod, the pressing surface of the button is pressed first to move the button to the second position, and thereby the edge of the positioning notch is disengaged from the annular fixing groove, so that the pull rod could be pulled out from the cavity via the through hole. The entire processes of assembling and disassembling the pull rod and the connecting rod are very simple, easy, and convenient. Besides, the lower portion of the pull rod is inserted into the cavity via the through hole on the top of the cavity, and the button is mounted in the cavity via the side hole on the side wall of the cavity, so that the button is moved in the axial direction of the side hole. In this way, the pull rod wouldn't hinder the user from pressing the pressing surface of the button, so that the user could press the center of the pressing surface of the button with only one finger to move the button smoothly, which is very convenient.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
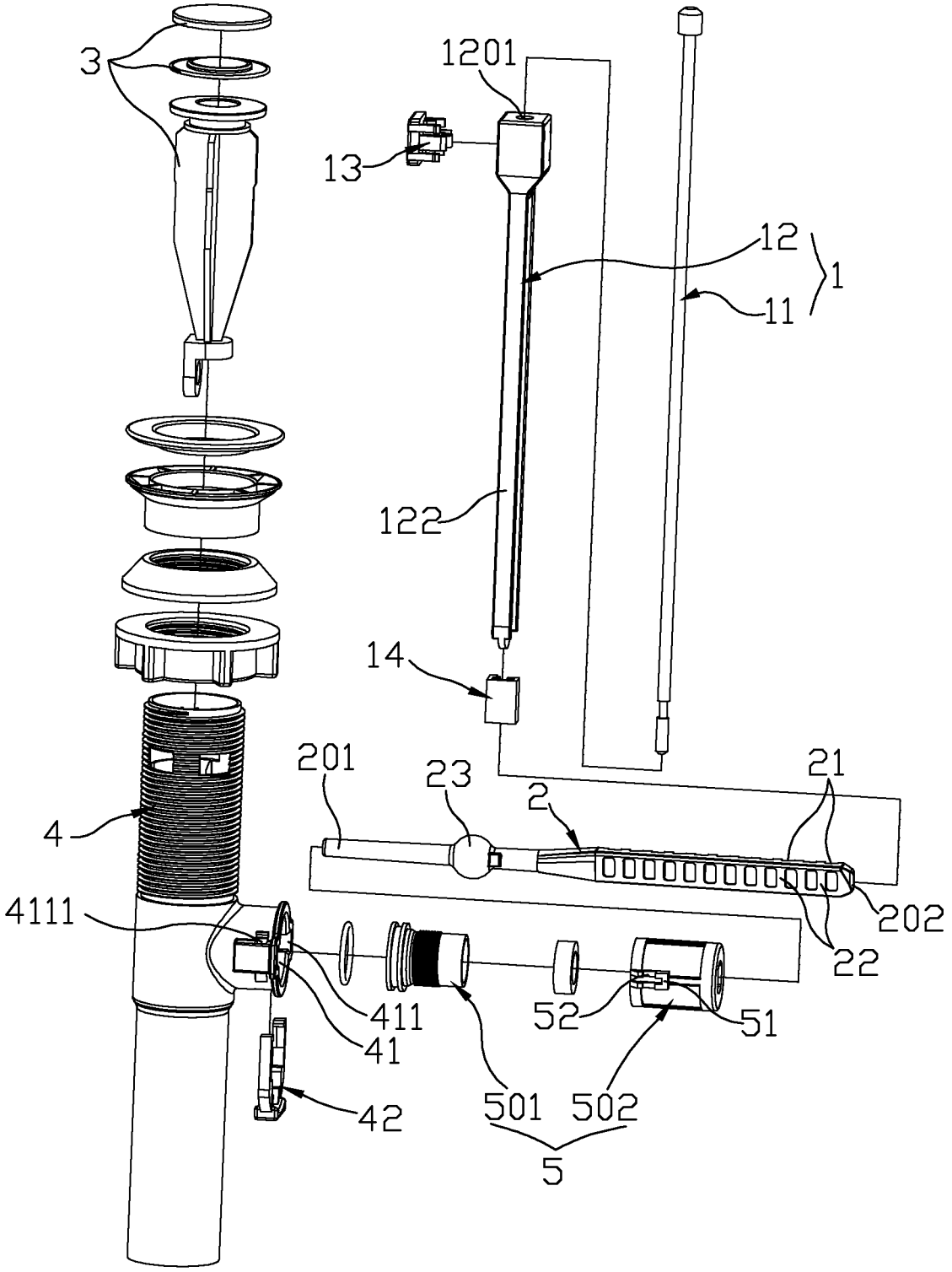
FIG. 1 is an exploded diagram of the drain plug linkage arrangement of an embodiment according to the present invention.
Figure 2:
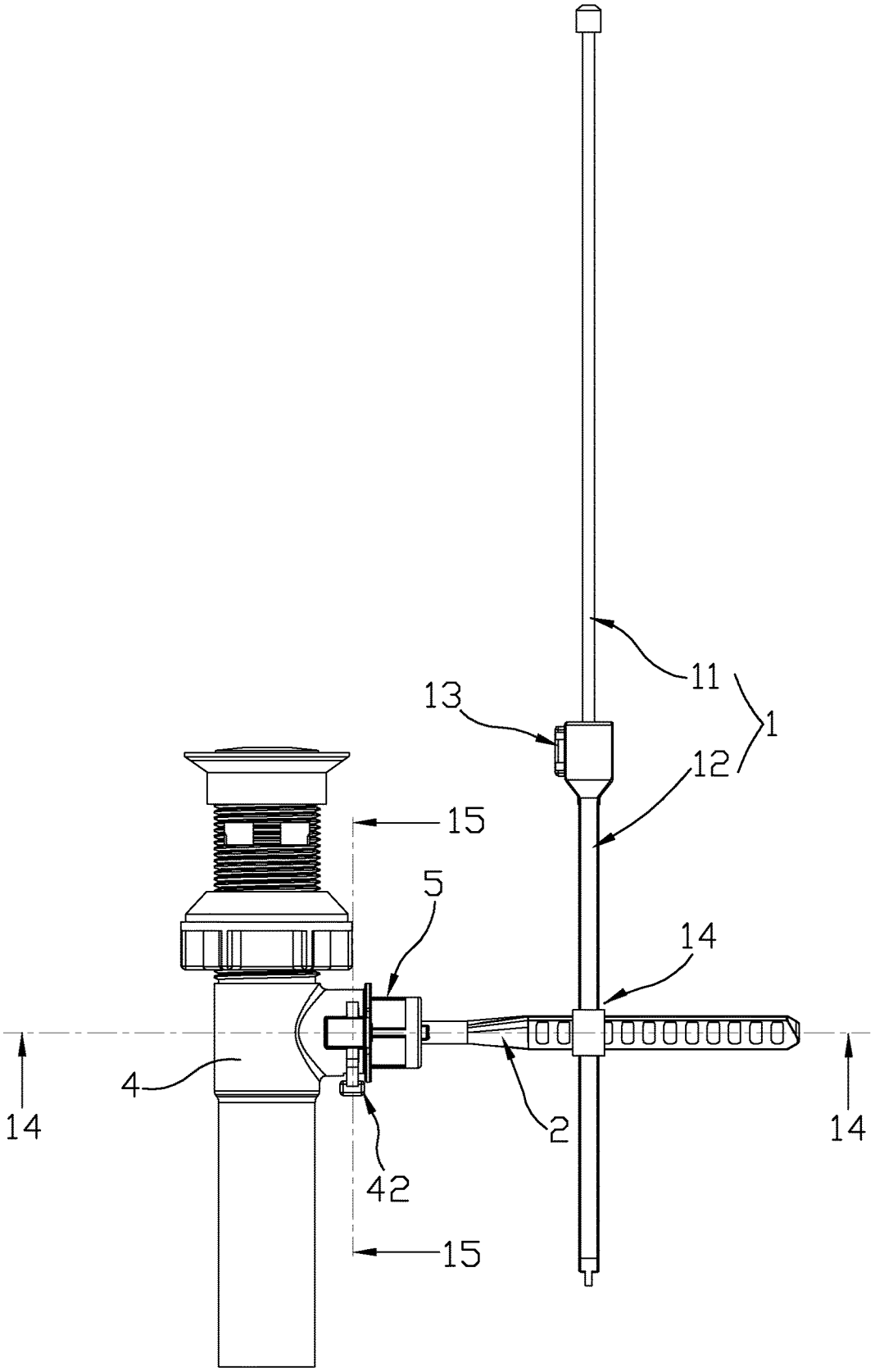
FIG. 2 is a schematic diagram of the drain plug linkage arrangement of said embodiment according to the present invention.
Figure 3:
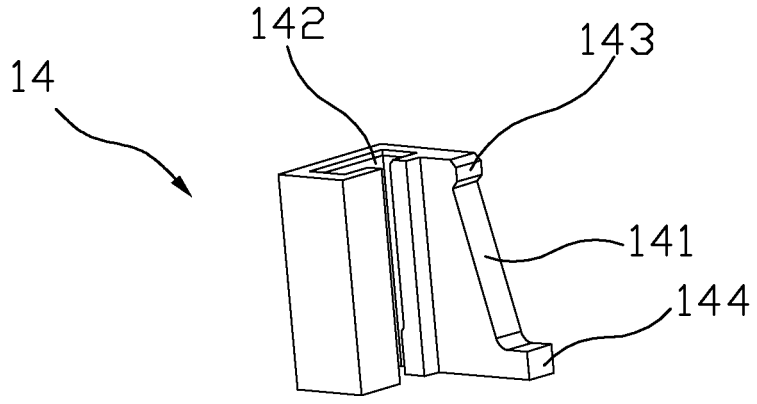
FIG. 3 is a schematic diagram, showing the sliding clip of said embodiment according to the present invention.
Figure 4:
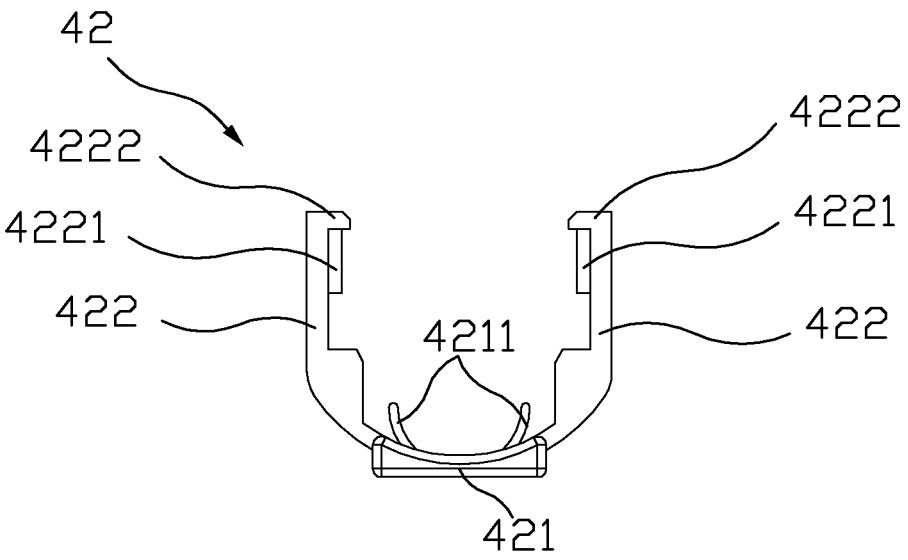
FIG. 4 is a schematic diagram, showing the U-shaped ring of said embodiment according to the present invention.
Figure 5:
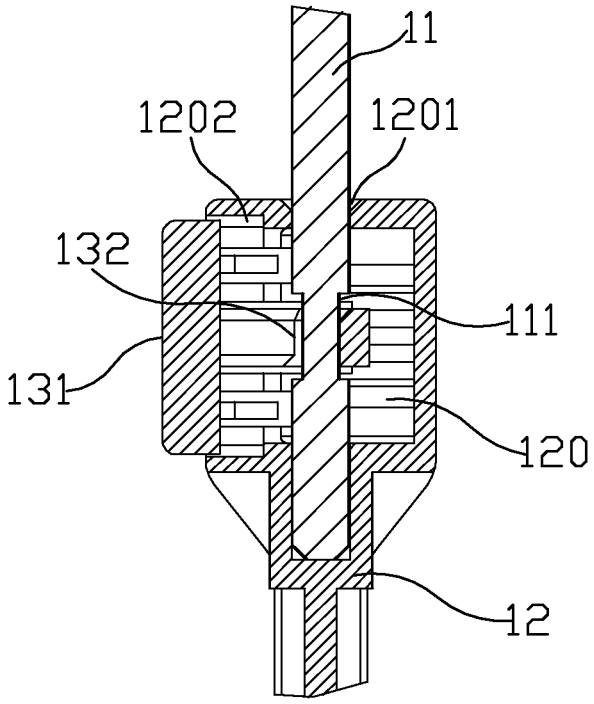
FIG. 5 is a schematic view, showing the button of the connecting rod of said embodiment is located at the first position.
Figure 6:
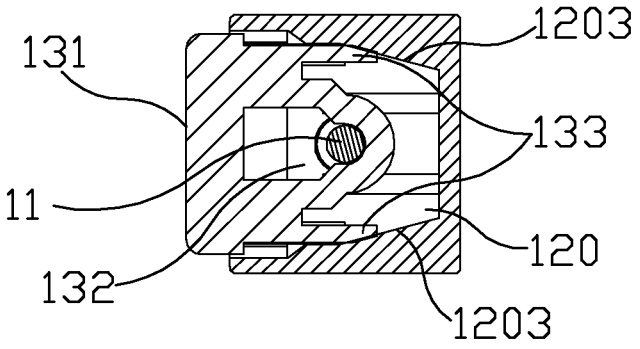
FIG. 6 is a schematic view, showing the button of the connecting rod of said embodiment is located at the first position seen from another perspective.
Figure 7:
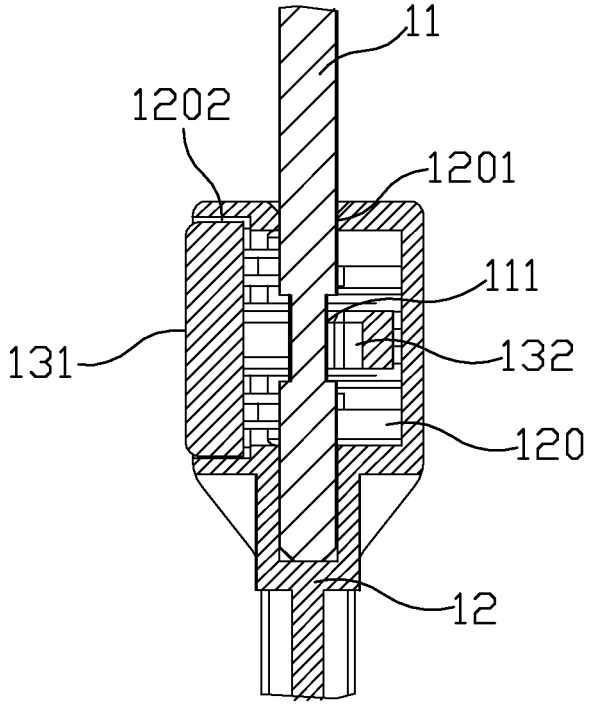
FIG. 7 is similar to FIG. 5, showing the button of the connecting rod of said embodiment is moved to the second position.
Figure 8:
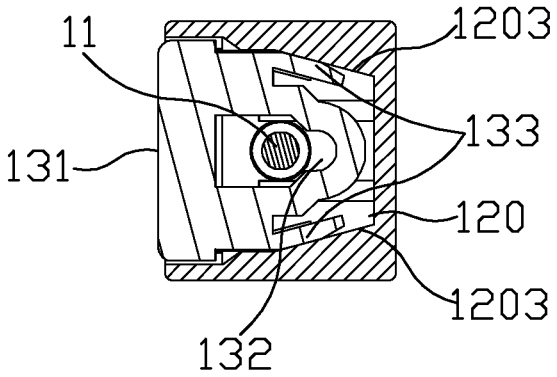
FIG. 8 is similar to FIG. 6, showing the button of the connecting rod of said embodiment is moved to the second position seen from another perspective.
Figure 9:
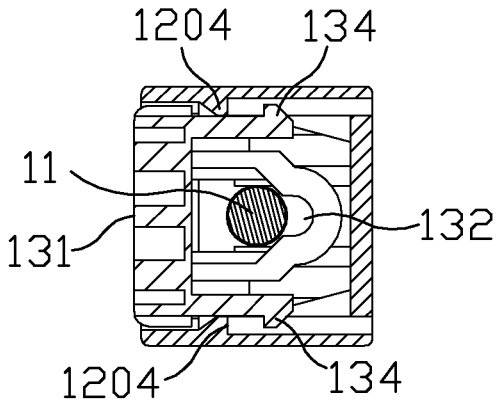
FIG. 9 is a schematic diagram, showing the elastic hook of the button of said embodiment is moved to the second position.
Figure 10:
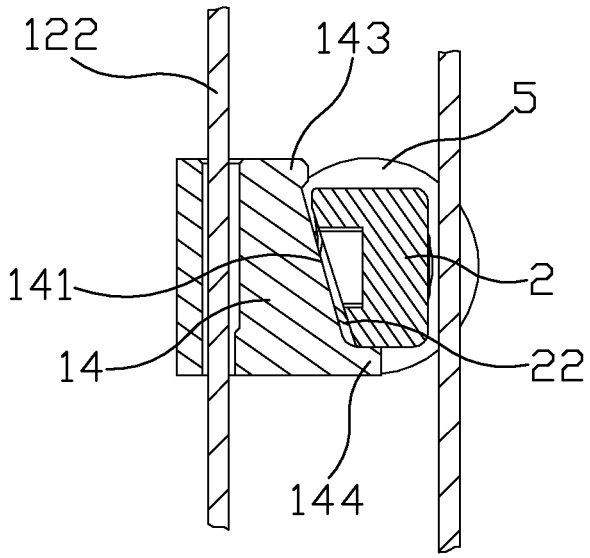
FIG. 10 is a schematic diagram, showing the tilted surface of the embodiment abuts against the slanted guiding surface.
Figure 11:
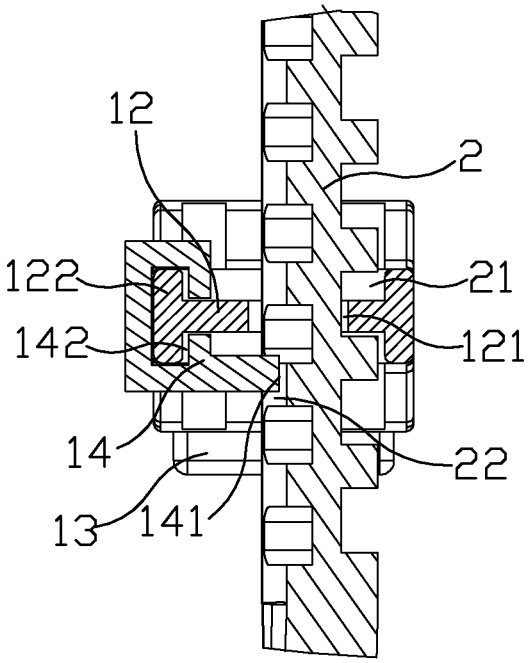
FIG. 11 is a schematic diagram, showing the edge of the positioning recesses of the embodiment is got stuck into the positioning slots.
Figure 12:
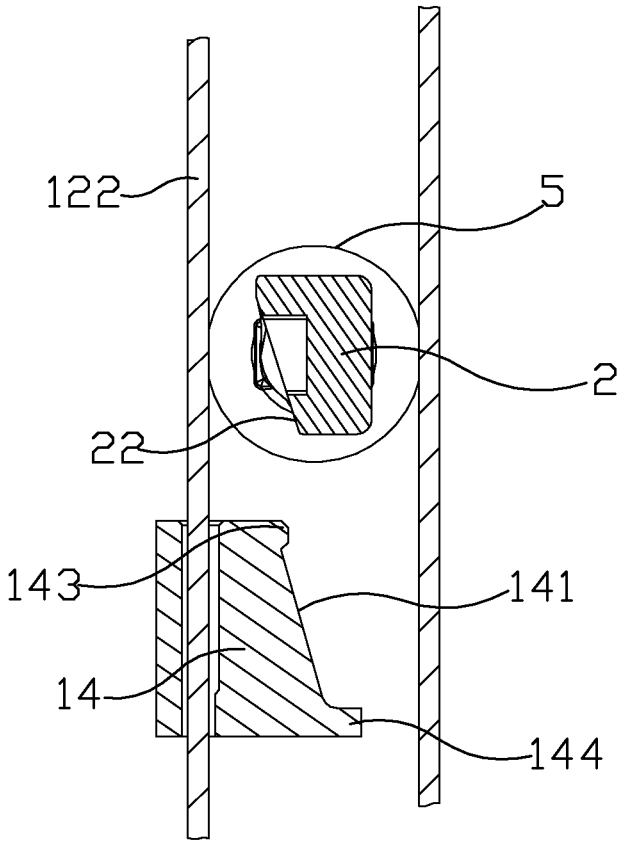
FIG. 12 is a similar to FIG. 10, showing the tilted surface of the embodiment is disengaged from the slanted guiding surface.
Figure 13:
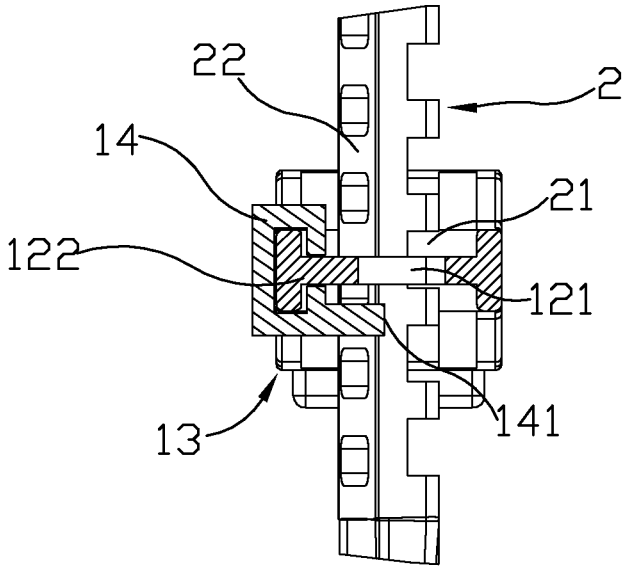
FIG. 13 is similar to FIG. 11, showing the edge of the positioning recesses of the embodiment is disengaged from the positioning slots.
Figure 14:
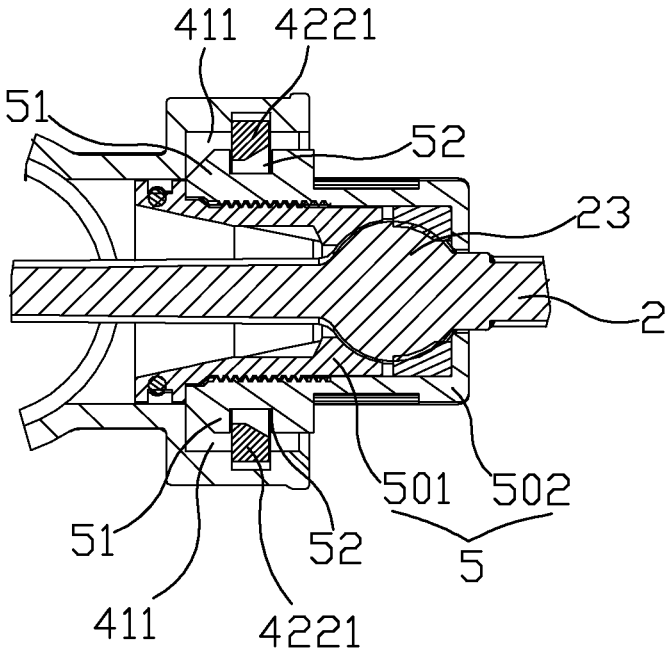
FIG. 14 is a partially sectional view taken along the 14-14 line in FIG. 2, showing the blocking member of the embodiment is located in the restricting groove.
Figure 15:
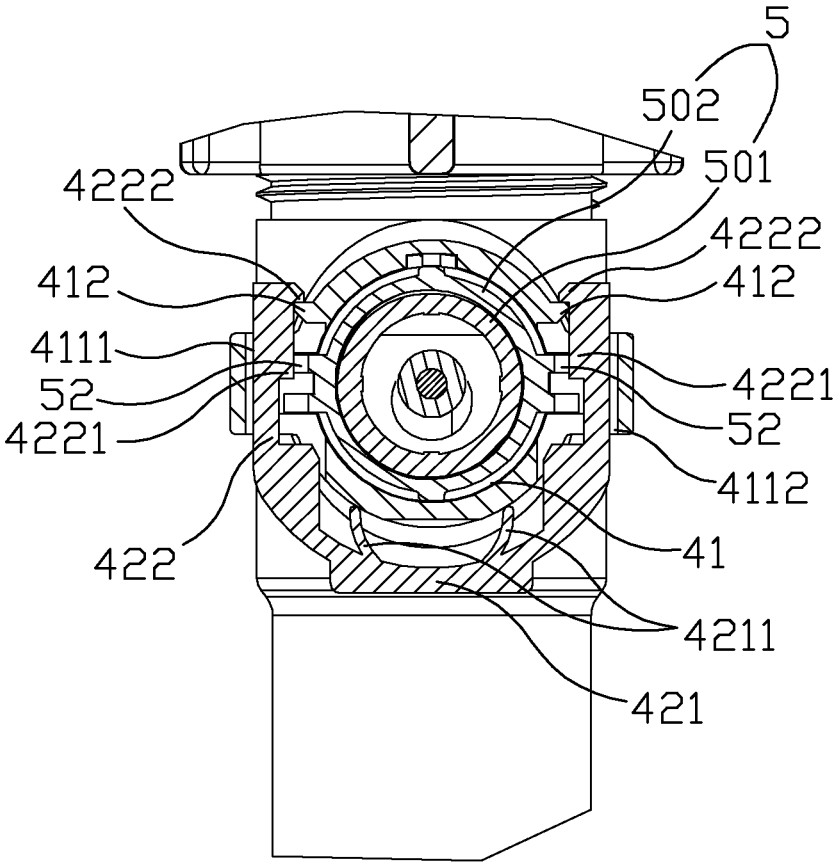
FIG. 15 is a partial sectional view taken along the 15-15 line in FIG. 2, showing the blocking member of the embodiment is located in the restricting groove seen from another perspective.
Figure 16:
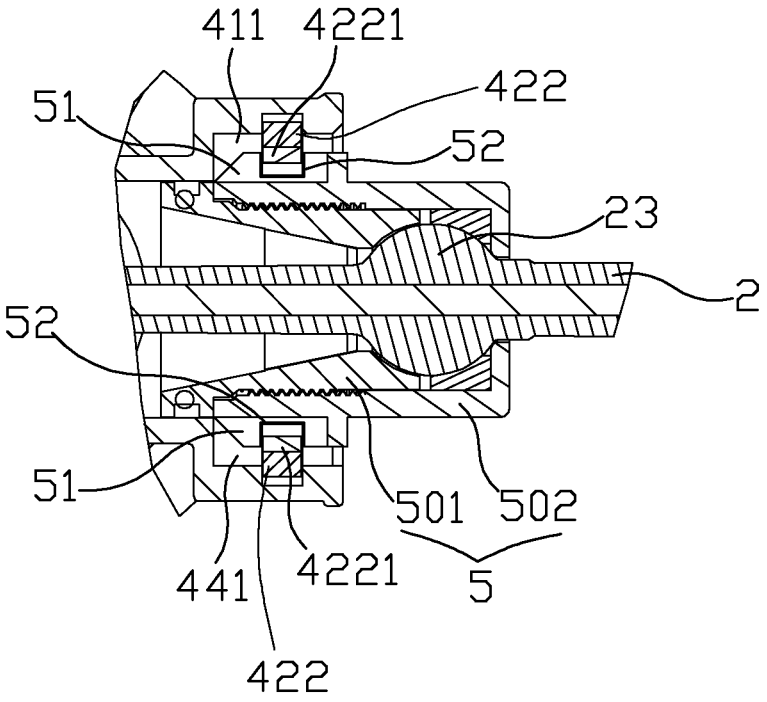
FIG. 16 is a partially sectional view taken along the 16-16 line in FIG. 17, showing the blocking member of the embodiment is disengaged from the restricting groove.
Figure 17:
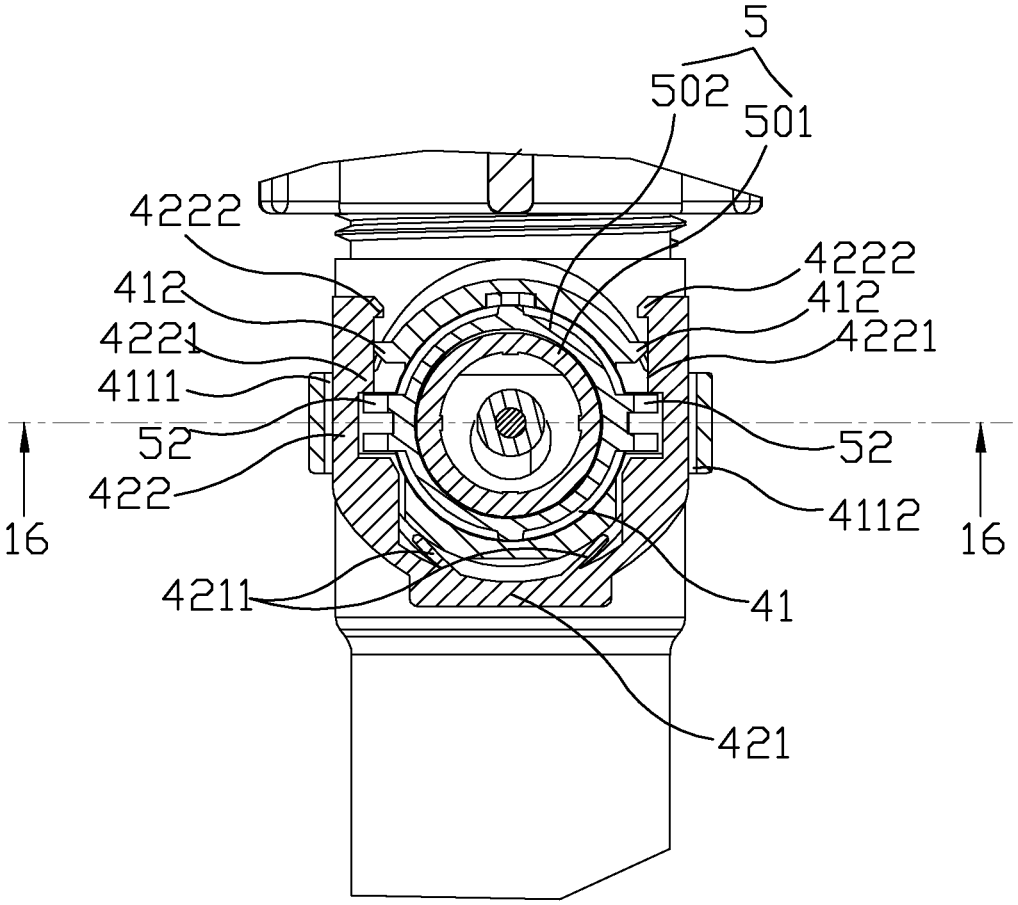
FIG. 17 is similar to FIG. 15, showing the blocking member of the embodiment is disengaged from the restricting groove seen from another perspective.

As illustrated in FIG. 1 to FIG. 17, a drain plug linkage arrangement of an embodiment according to the present invention includes a pull rod assembly 1, an operating rod 2, a drain plug 3, and a drain pipe 4, wherein the drain plug 3 is movably disposed in the drain pipe 4. The pull rod assembly 1 includes a pull rod 11 and a connecting rod 12 which is connected to the pull rod 11. The operating rod 2 has a first end 201 and a second end 202, wherein the first end 201 of the operating rod 2 is inserted into the drain pipe 4 from a sidewall of the drain pipe 4 and is connected to the drain plug 3. The operating rod 2 is connected to the connecting rod 12. The structure of said drain plug 3 and a mechanism of movable connecting structure between the drain plug 3 and the drain pipe 4 are a well-known skill, thus the relative details are not described herein.

Specifically, as illustrated in FIG. 1 and FIG. 5 to FIG. 9, an annular fixing groove 111 is formed on a lower portion of said pull rod 11. The connecting rod 12 has a cavity 120 in a top portion of the connecting rod 12, wherein the connecting rod 12 has a through hole 1201 on a top of the cavity 120 and a side hole 1202 on a side wall of the cavity 120. The lower portion of the pull rod 11 is inserted into the cavity 120 from the through hole 1201. A button 13 is movably disposed in the cavity, and an outer end of the button 13 forms a pressing surface 131; an inner portion of the button 13 is inserted into the cavity 120 from the side hole 1202 of the cavity 120 and is able to be moved between a first position and a second position in an axial direction of the side hole 1202. The inner portion of the button 13 has a positioning notch 132, and an edge of the positioning notch 132 is movably engaged with an annular fixing groove 111. The connecting rod 2 further includes a button resilient structure which is constituted by the cavity 120 and the button 13. When the pressing surface 131 of the button 13 is released from being pressed, the button resilient structure urges the button 13 to move to the first position, so that the edge of the positioning notch 132 is got stuck in the annular fixing groove 111, thereby to fix the lower portion of the pull rod 11 in the cavity. When the pressing surface 131 of the button 13 is pressed to move the button 13 to the second position, the edge of the positioning notch 132 is disengaged from the annular fixing groove 111, so that the lower portion of the pull rod 11 could be pulled out from the cavity 120. Referring to FIG. 1 and FIG. 5 to FIG. 8, in the current embodiment, said button resilient structure is constituted by two elastic arms 133 respectively connected to two sides of the button 13 and two guiding slopes 1203 formed on an interior wall of said cavity 120. Each of the two elastic arms 133 abuts against one of the two guiding slopes 1203. When the pressing surface 131 of the button 13 is just released from being pressed, the elastic arms 131 abutting against the guiding slopes 1203 apply a force to the guiding slopes 1203, so that the elastic arms 131 could slide along the guiding slope 1203 thereby to urge the button 13 to move back to the first position from the second position. In the current embodiment, at least two elastic hooks 134 are disposed on said button 13; the interior wall of the cavity 120 has a blocking edge 1204 which is adapted to be movably engaged with the elastic hooks 134. By engaging the elastic hooks 134 and the blocking edge 1204, the button 13 could be prevented from disengaging from the cavity 120. When the pull rod 11 is about to be assembled with the connecting rod 12, press the pressing surface 131 of the button 13 first to move the button 13 to the second position, and then, insert the lower portion of the pull rod 11 into the cavity 120 from the through hole 1201, and finally, release the pressing surface 131 of the button 13, the button resilient structure restores to drives the button to return to the first position, so that the edge of the positioning notch 132 is wedged into the annular fixing groove 111 to fix the lower portion of the pull rod 11 in the cavity 120. When the pull rod 11 is about to be detached from the connecting rod 12, press the pressing surface 131 of the button 13 first to move the button 13 to the second position to disengage the edge of the positioning notch 132 from the annular fixing groove 111, and then, pull the lower portion of the pull rod 11 out of the cavity 120 from the through hole 1201, and finally release the pressing surface 131 of the button 13. In this way, the assembling and the dissembling processes between the pull rod 11 and the connecting rod 12 would be very convenient. Besides, the lower portion of the pull rod 11 is inserted into the cavity 120 from the through hole 1201 on the top, and the button is inserted into the cavity 120 from the side wall of the cavity 120, so the pull rod 11 wouldn't hinder the user from pressing the pressing surface 131 of the button 13. Therefore, the user could press a center of the pressing surface 131 of the button 13 to move the button 13 smoothly by only one finger, which is quite easy and convenient for operating.

In order to illustrate easily, three axial directions which are perpendicular to one another are defined, wherein the three axial directions include a first axial direction which is an axial direction of the side hole 1202, a second axial direction which is an axial direction of the through hole 1201, and a third axial direction perpendicular to both the first axial direction and the second axial direction. Top and bottom are defined in the second axial direction; front and rear are defined in the third axial direction. Referring to FIG. 1, FIG. 3, and FIG. 10 to FIG. 13, a plurality of positioning slots 21 are disposed on a rear surface of the operating rod 2, and a plurality of slanted guiding surfaces 22 are disposed on a front surface of the operating rod 2 corresponding to the positioning slots 21, wherein each of the slanted guiding surfaces 22 is rearwards slanted from top down. The front surface and the rear side surface face opposite directions in the third axial direction. In the current embodiment, a plurality of positioning perforations 121 are arranged on the connecting rod 12 in an axial direction of the connecting rod 12. A sliding clip 14 is mounted on the connecting rod 12 and is able to move up and down. Said sliding clip 14 has a tilted surface 141 matching with the slanted guiding surfaces 22 and adapted to be selectively abutted against the slanted guiding surface 22. A sliding track 122 is formed on a front side of the connecting rod 12, and a C-shaped sliding groove 142 adapted to be engaged with the sliding track 122 of the connecting rod 12 is disposed on the sliding clip 14, thereby to movably engage the sliding clip 14 and the connecting rod 12 via the sliding track 122 and the C-shaped sliding groove 142. The second end 202 of the operating rod 2 passes through one of the positioning perforations 121 of the connecting rod 12, wherein when the tilted surface 141 of the sliding clip 14 abuts against the slanted guiding surface 22 of the operating rod 2, the operating rod 2 is pressed by the tilted surface 141 of the sliding clip 14 to move rearwards, so that the edge of the corresponding positioning perforation 121 is got stuck into one of the positioning slots 21, thereby to connect the operating rod 2 and the connecting rod 12. When the operating rod 2 is about to be assembled with the connecting rod 12, the second end 202 of the operating rod 2 passes through one of the positioning perforations 121 on the connecting rod 12 first, and the operating rod 2 is moved to align one of the positioning slots 21 of the operating rod 2 with the corresponding positioning perforation 121 of connecting rod 12, and then the sliding clip 14 on the connecting rod 12 is moved to make the tilted surface 141 abut against the slanted guiding surface 22 of the operating rod 2, so that the operating rod 2 is moved rearwards to engage the edge of the corresponding positioning perforation 121 and the corresponding positioning slot 21, thereby to connect the operating rod 2 and the connecting rod 12. When the operating rod 2 is about to be detached from the connecting rod 12, the sliding clip 14 is moved downwards, so that the tilted surface 141 of the sliding clip 14 is disengaged from the slanted guiding surface 22 of the operating rod 2, and then either the operating rod 2 or the connecting rod 12 is moved to make the edge of the corresponding positioning perforation 121 of the connecting rod 12 disengages from the corresponding positioning slot 21, and finally, the operating rod 2 is pulled out from the positioning perforations 121 of the connecting rod 12. In this way, the assembling and the disassembling processes between the operating rod 2 and the connecting rod 12 could be very convenient. Besides, a connecting site between the connecting rod 12 and the operating rod 2 could be adjusted by engaging different positioning perforations with different positioning slots 21. In other embodiments, said operating rod 2 could be directly hinge on the connecting rod 12. In the current embodiment, a curved protruding portion 143 is formed at an upper end of said tilted surface 141 and is adapted to be detachably engaged with a top surface of the operating rod 2; a stopping protruding portion 144 is formed at a lower end of the tilted surface 141 and is adapted to be abutted against a bottom surface of the operating rod 2. When the edge of one of the positioning perforations 121 is engaged with one of the positioning slots 21, the curved protruding portion 143 is engaged with the top surface of the operating rod 2, and the stopping protruding portion 144 abuts against the bottom surface of the operating rod 2 in order to ensure that the tilted surface 141 firmly abuts against the slanted guiding surface 22, thereby to ensure that the edge of one of the positioning perforations 121 is firmly engaged with the corresponding positioning slot 21. When the sliding clip 14 is moved downwards, the curved protruding portion 143 is moved downwards along the slanted guiding surface 22 to be disengaged with the top surface of the operating rod 2.

As illustrated in FIGS. 1, 4, and 14-17, said operating rod 2 includes a spherical body 23, wherein the spherical body 23 and the operating rod 12 could be integrally formed as a monolithic unit or be separately formed and then be assembled. The spherical body 23 is located between the first end 201 and the second end 202 of the operating rod 2 and is rotatably disposed in a sleeve 5. The sleeve 5 is constituted by a connecting seat 501 and a connecting cap 502, wherein the connecting seat 501 and the connecting cap 502 are joined to each other to form the sleeve 5. In the current embodiment, the connecting seat 501 is screwed with the connecting cap 502. A first through hole is disposed on the connecting seat 501 and is adapted to be passed through by the first end 201 of the operating rod 2; a second through hole is disposed on the connecting cap 502 and is adapted to be passed through by the second end 202 of the operating rod 2. An external wall of the sleeve 5 has two restricting protruding portions 51 on opposite sides of the external wall, wherein the two restricting protruding portions 51 are disposed on an outer wall of the connecting cap 502, and each of the two restricting protruding portions 51 has a restricting groove 52 thereon. A tube with an opening 41 is formed on a side wall of the drain pipe 4 for mounting the operating rod 2. Two positioning grooves 411 corresponding to the two restricting protruding portions 51 and expanding in an axial direction of the opening 41 are formed on an inner wall of the tube. A first perforation 4111 is formed on two opposite walls of one of the positioning grooves 411, and a second perforation 4112 is formed on two opposite walls of the other positioning groove 411; an axial direction of the first perforation 4111 and an axial direction of the second perforation 4112 are parallel to the second axial direction. At least a part of the sleeve 5 is disposed into the tube via the opening 41, and the two restricting protruding portions 51 are movably and respectively engaged with the two positioning grooves 411. An U-shaped ring 42 is mounted onto the tube, and includes a pressing portion 421 and two restricting arms 422 respectively and oppositely connected to two opposite ends of the pressing portion 421. An elastic portion is disposed on an inner side of the pressing portion 421 and is adapted to be abutted against an outer wall of the tube. In the current embodiment, the elastic portion is an elastic claw 4211 connected to the inner side of the pressing portion 421. An inner side of each of the restricting arms 422 is disposed with a blocking member 4221. In an embodiment, the pressing portion 421, the restricting arms 422, the elastic portion, and the blocking member 4221 are, but not limited to, integrally formed as a monolithic unit. Two restricting arms 42 respectively pass through the first perforation 4111 and the second perforation 4112 of the two positioning grooves 411, and the blocking members 4221 are movably engaged with the restricting grooves 52. An end portion of each of the restricting arms 422 is disposed with a blocking hook 4222. Two locking portions 412 are disposed on the outer wall of the tube and are adapted to be engaged with the blocking hooks 4222. When the sleeve 5 is about to be assembled with the tube, the pressing portion 421 of the U-shaped ring 42 is pressed first to move the blocking members 4221 of the two restricting arms 422 to a position where the blocking members 4221 couldn't hinder the restricting protruding portion 51 from moving in the positioning groove 41, wherein at this time, the blocking hooks 4222 of the restricting arms 422 are disengaged from the locking portions 412 on the outer wall of the tube. After that, the sleeve 5 is inserted into the tube via the opening 41, so that the two restricting protruding portions 51 of the sleeve 5 could be respectively moved along the two positioning grooves 411 to a position that the restricting grooves 52 of the two restricting protruding portions 51 of the sleeve 5 align with the blocking members 4221 of the restricting arms 422. Finally, release the pressing portion 421 of the U-shaped ring 42 from being pressed, so that the elastic portion resiles to move the restricting arms 422 in a direction toward the pressing portion 421 until the blocking hook 4222 of the restricting arms 422 are engaged with the locking portion 412 on the outer wall of the opening 41. At this time, the blocking member 4221 of the restricting arms 422 is engaged within the restricting groove 52 of the restricting protruding portion 51 to restrict the sleeve 5 to move in the axial direction of the opening 41. When the sleeve 5 is about to be disassembled from the tube, the pressing portion 421 of the U-shaped ring 42 is pressed first to disengage the blocking member 4221 of the two restricting arms 422 from the restricting groove 52, and then the sleeve 5 could be pulled out from the opening 41. In this way, the assembling and the disassembling processes between the sleeve 5 and the tube could be very easy and convenient. In other embodiments, the sleeve 5 could be, but not limited to, screwed, buckled, or hooked with the tube.

It must be pointed out that the embodiment described above is only a preferred embodiment of the present invention. All equivalent structures which employ the concepts disclosed in this specification and the appended claims should fall within the scope of the present invention.

What is claimed is:

1. A drain plug linkage arrangement, comprising a pull rod assembly, an operating rod, a drain plug, and a drain pipe, wherein the drain plug is movably disposed in the drain pipe; the pull rod assembly comprises a pull rod and a connecting rod which is connected to the pull rod; the operating rod has a first end and a second end, wherein the first end of the operating rod is inserted into the drain pipe from a sidewall of the drain pipe and is connected to the drain plug; the operating rod is connected to the connecting rod; the drain plug linkage arrangement is characterized in that:

an annular fixing groove is formed on a lower portion of said pull rod; the connecting rod has a cavity in a top portion of the connecting rod, wherein the connecting rod has a through hole on a top of the cavity and a side hole on a side wall of the cavity; the lower portion of the pull rod is inserted into the cavity from the through hole; a button is movably disposed in the cavity, and an outer end of the button forms a pressing surface; an inner portion of the button is inserted into the cavity from the side hole of the connecting rod and is able to be moved between a first position and a second position in an axial direction of the side hole; the inner portion of the button has a positioning notch, and an edge of the positioning notch is movably engaged with the annular fixing groove; the connecting rod further comprises a button resilient structure which is constituted by the cavity and the button; when the pressing surface of the button is released from being pressed, the button resilient structure urges the button to move to the first position, so that the edge of the positioning notch is engaged into the annular fixing groove; when the pressing surface of the button is pressed to move to the second position, the edge of the positioning notch is disengaged from the annular fixing groove;

wherein a plurality of positioning slots is disposed on a rear surface of the operating rod, and a plurality of slanted guiding surfaces is disposed on a front surface of the operating rod corresponding to the plurality of positioning slots, wherein each of the plurality of slanted guiding surfaces is rearward slanted from top down; a plurality of positioning perforations are arranged in an axial direction of the connecting rod; a sliding clip is movably mounted on the connecting rod and has a tilted surface matching with the plurality of slanted guiding surfaces, and the tilted surface is adapted to be selectively abutted against the plurality of slanted guiding surface; the second end of the operating rod passes through one of the plurality of positioning perforations of the connecting rod; when the tilted surface of the sliding clip abuts against the slanted guiding surface of the operating rod, the operating rod is pressed by the tilted surface of the sliding clip to move rearward, so that the edge of the corresponding positioning perforation passed through by the second end of the operating rod gets stuck into one of the positioning slots.

2. The drain plug linkage arrangement of claim 1, wherein said button resilient structure is constituted by two elastic arms respectively connected to two sides of the button and two guiding slopes formed on an interior wall of said cavity; each of the two elastic arms abuts against one of the two guiding slopes.

3. The drain plug linkage arrangement of claim 1, wherein at least two elastic hooks are disposed on the button, and an interior wall of the cavity has a blocking edge which is adapted to be movably engaged with the at least two elastic hooks.

4. The drain plug linkage arrangement of claim 1, wherein a curved protruding portion is formed at an upper end of the tilted surface and is adapted to be detachably engaged with a top surface of the operating rod; a stopping protruding portion is formed at a lower end of the tilted surface and is adapted to be abutted against a bottom surface of the operating rod.

5. The drain plug linkage arrangement of claim 1, wherein the operating rod comprises a spherical body which is located between the first end and second end of the operating rod and is rotatably disposed in a sleeve; an external wall of the sleeve has two restricting protruding portions on opposite sides of the external wall, and each of the two restricting protruding portions has a restricting groove; a tube with an opening is formed on a side wall of the drain pipe for mounting the operating rod, and two positioning grooves corresponding to the two restricting protruding portions and extending in an axial direction of the opening are formed on an inner wall of the tube; a first perforation is formed on two opposite walls of one of the positioning grooves, and a second perforation is formed on two opposite walls of the other positioning groove; an axial direction of the first perforation and an axial direction of the second perforation are parallel to an axial direction of the through hole; at least a part of said sleeve is disposed into the tube via the opening, and the two restricting protruding portions are movably and respectively engaged with the two positioning grooves; an U-shaped ring is mounted onto the tube and comprises a pressing portion and two restricting arms respectively and oppositely connected to two opposite ends of the pressing portion; an elastic portion is disposed on an inner side of the pressing portion and is adapted to be abutted against an outer wall of the tube; an inner side of each of the restricting arms is disposed with a blocking member; the two restricting arms respectively pass through the first perforation and the second perforation of the two positioning grooves, and the blocking members are movably engaged with the restricting grooves.

6. The drain plug linkage arrangement of claim 5, wherein an end portion of each of the restricting arms is disposed with a blocking hook; two locking portions are disposed on the outer wall of the tube and are adapted to be engaged with the blocking hooks.

7. The drain plug linkage arrangement of claim 5, wherein the elastic portion is an elastic claw connected to the inner side of the pressing portion.

8. The drain plug linkage arrangement of claim 5, wherein the sleeve is constituted by a connecting seat and a connecting cap; the connecting seat and the connecting cap are joined to each other to form the sleeve; a first through hole is disposed on the connecting seat and is adapted to be passed through by the first end of the operating rod, and a second through hole is disposed on the connecting cap and is adapted to be passed through by the second end of the operating rod; the two restricting protruding portions are disposed on an outer wall of the connecting cap.

9. A drain plug linkage arrangement, comprising a pull rod assembly, an operating rod, a drain plug, and a drain pipe, wherein the drain plug is movably disposed in the drain pipe; the pull rod assembly comprises a pull rod and a connecting rod which is connected to the pull rod; the operating rod has a first end and a second end, wherein the first end of the operating rod is inserted into the drain pipe from a sidewall of the drain pipe and is connected to the drain plug; the operating rod is connected to the connecting rod; the drain plug linkage arrangement is characterized in that:

an annular fixing groove is formed on a lower portion of said pull rod; the connecting rod has a cavity in a top portion of the connecting rod, wherein the connecting rod has a through hole on a top of the cavity and a side hole on a side wall of the cavity; the lower portion of the pull rod is inserted into the cavity from the through hole; a button is movably disposed in the cavity, and an outer end of the button forms a pressing surface; an inner portion of the button is inserted into the cavity from the side hole of the connecting rod and is able to be moved between a first position and a second position in an axial direction of the side hole; the inner portion of the button has a positioning notch, and an edge of the positioning notch is movably engaged with the annular fixing groove; the connecting rod further comprises a button resilient structure which is constituted by the cavity and the button; when the pressing surface of the button is released from being pressed, the button resilient structure urges the button to move to the first position, so that the edge of the positioning notch is engaged into the annular fixing groove; when the pressing surface of the button is pressed to move to the second position, the edge of the positioning notch is disengaged from the annular fixing groove;

wherein the operating rod comprises a spherical body which is located between the first end and second end of the operating rod and is rotatably disposed in a sleeve; an external wall of the sleeve has two restricting protruding portions on opposite sides of the external wall, and each of the two restricting protruding portions has a restricting groove; a tube with an opening is formed on a side wall of the drain pipe for mounting the operating rod, and two positioning grooves corresponding to the two restricting protruding portions and extending in an axial direction of the opening are formed on an inner wall of the tube; a first perforation is formed on two opposite walls of one of the positioning grooves, and a second perforation is formed on two opposite walls of the other positioning groove; an axial direction of the first perforation and an axial direction of the second perforation are parallel to an axial direction of the through hole; at least a part of said sleeve is disposed into the tube via the opening, and the two restricting protruding portions are movably and respectively engaged with the two positioning grooves; an U-shaped ring is mounted onto the tube and comprises a pressing portion and two restricting arms respectively and oppositely connected to two opposite ends of the pressing portion; an elastic portion is disposed on an inner side of the pressing portion and is adapted to be abutted against an outer wall of the tube; an inner side of each of the restricting arms is disposed with a blocking member; the two restricting arms respectively pass through the first perforation and the second perforation of the two positioning grooves, and the blocking members are movably engaged with the restricting grooves.

10. The drain plug linkage arrangement of claim 9, wherein said button resilient structure is constituted by two elastic arms respectively connected to two sides of the button and two guiding slopes formed on an interior wall of said cavity; each of the two elastic arms abuts against one of the two guiding slopes.

11. The drain plug linkage arrangement of claim 9, wherein at least two elastic hooks are disposed on the button, and an interior wall of the cavity has a blocking edge which is adapted to be movably engaged with the at least two elastic hooks.

12. The drain plug linkage arrangement of claim 9, wherein a curved protruding portion is formed at an upper end of the tilted surface and is adapted to be detachably engaged with a top surface of the operating rod; a stopping protruding portion is formed at a lower end of the tilted surface and is adapted to be abutted against a bottom surface of the operating rod.

13. The drain plug linkage arrangement of claim 9, wherein an end portion of each of the restricting arms is disposed with a blocking hook; two locking portions are disposed on the outer wall of the tube and are adapted to be engaged with the blocking hooks.

14. The drain plug linkage arrangement of claim 9, wherein the elastic portion is an elastic claw connected to the inner side of the pressing portion.

15. The drain plug linkage arrangement of claim 9, wherein the sleeve is constituted by a connecting seat and a connecting cap; the connecting seat and the connecting cap are joined to each other to form the sleeve; a first through hole is disposed on the connecting seat and is adapted to be passed through by the first end of the operating rod, and a second through hole is disposed on the connecting cap and is adapted to be passed through by the second end of the operating rod; the two restricting protruding portions are disposed on an outer wall of the connecting cap.

* * * * *